US011248399B2

(12) United States Patent
Xu

(10) Patent No.: US 11,248,399 B2
(45) Date of Patent: Feb. 15, 2022

(54) CLOTHES TAG

(71) Applicant: SUNVAN (SHANGHAI) ELECTRONICS TECHNOLOGY CO., LTD., Shanghai (CN)

(72) Inventor: Jianchao Xu, Shanghai (CN)

( * ) Notice: Subject to any disclaimer, the term of this patent is extended or adjusted under 35 U.S.C. 154(b) by 0 days.

(21) Appl. No.: 17/273,722

(22) PCT Filed: Aug. 21, 2019

(86) PCT No.: PCT/CN2019/101776
§ 371 (c)(1),
(2) Date: Mar. 4, 2021

(87) PCT Pub. No.: WO2021/000388
PCT Pub. Date: Jan. 7, 2021

(65) Prior Publication Data

US 2021/0310283 A1 Oct. 7, 2021

(30) Foreign Application Priority Data

Jul. 1, 2019 (CN) ..... 201921022273.0

(51) Int. Cl.
*E05B 73/00* (2006.01)
*G08B 13/24* (2006.01)
*G09F 3/20* (2006.01)

(52) U.S. Cl.
CPC ..... *E05B 73/0017* (2013.01); *G08B 13/2434* (2013.01); *G09F 3/208* (2013.01)

(58) Field of Classification Search
CPC ..... G08B 13/2434; G08B 13/2448; E05B 73/0017
See application file for complete search history.

(56) References Cited

U.S. PATENT DOCUMENTS 8,581,730 B2 * 11/2013 Forster ..... G06K 19/07703 340/572.8
9,007,214 B2 * 4/2015 Joseph ..... G08B 13/2417 340/572.1
2003/0116632 A1 * 6/2003 Zimmerman ..... G08B 13/2434 235/487

(Continued)

FOREIGN PATENT DOCUMENTS

CN 2425400 Y 3/2001
CN 2647109 Y 10/2004

(Continued)

OTHER PUBLICATIONS

International search report of PCT/CN2019/101776.

*Primary Examiner* — Hoi C Lau

(57) ABSTRACT

The present application discloses a clothes tag, relating to the field of a tag. The clothes tag includes a casing provided with an anti-theft clasp and a screen inserted on one side thereof for showing the information of clothes. Regarding the problem of losing its shape present in clothes for having too many accessories hanged thereon in the prior art, the tag according to the present application is provided with the anti-theft clasp and the screen, so to reduce the accessories to be handed on clothes and improve the trying-on experience of a client. In addition, the information shown on the screen can be changed as needed, achieving repeated use of the tag according to the present application.

5 Claims, 3 Drawing Sheets

(56) References Cited

U.S. PATENT DOCUMENTS

| | | | | |
|---|---|---|---|---|
| 2005/0152108 | A1* | 7/2005 | Goel | G06Q 10/087 361/679.01 |
| 2006/0139176 | A1 | 6/2006 | Skjellerup et al. | |
| 2007/0187266 | A1* | 8/2007 | Porter | G06Q 10/087 206/232 |
| 2009/0014512 | A1* | 1/2009 | Gelbman | G06Q 30/06 235/375 |
| 2009/0309736 | A1* | 12/2009 | Heurtier | G08B 13/2448 340/572.8 |
| 2011/0095089 | A1* | 4/2011 | Kolton | G06K 19/041 235/492 |
| 2011/0289023 | A1* | 11/2011 | Forster | G06Q 99/00 705/500 |
| 2013/0194097 | A1* | 8/2013 | Joseph | G08B 13/246 340/572.1 |
| 2016/0227897 | A1* | 8/2016 | Jobling | G09F 3/201 |
| 2019/0354824 | A1* | 11/2019 | Mohiuddin | G06K 19/0712 |
| 2020/0050913 | A1* | 2/2020 | Bergman | G06K 19/07707 |
| 2021/0125018 | A1* | 4/2021 | Bergman | G06K 19/0723 |
| 2021/0225143 | A1* | 7/2021 | Weakley | G08B 13/2417 |
| 2021/0310283 | A1* | 10/2021 | Xu | G09F 9/37 |
| 2021/0327234 | A1* | 10/2021 | Chandramowle | G08B 13/2417 |

FOREIGN PATENT DOCUMENTS

| | | | |
|---|---|---|---|
| CN | 1801229 | A | 7/2006 |
| CN | 2876953 | Y | 3/2007 |
| CN | 101030314 | A | 9/2007 |
| CN | 201638330 | U | 11/2010 |

* cited by examiner

CLOTHES TAG

FIELD

The present application relates to the field of a tag, and, in particular, to a clothes tag.

BACKGROUND

In a dress sale, for the purpose of preventing from being stolen or taken away by a client without paying, a hardly detachable anti-theft clasp and an acoustic magnetic alarm is usually installed on clothes.

As an existing anti-theft clasp, for example, in a Chinese Patent Publication No. CN105405243A, a radio frequency identification (RFID) buzzer anti-theft clasp for clothes is disclosed. It comprises a casing, in which a magnetic self-locking device, a RFID tag, a button cell, and a buzzer are installed. The RFID tag is connected with the button cell and the buzzer, respectively. An ink box containing ink is provided in the casing.

In the above patent application, the anti-theft clasp is only used for anti-theft. A tag for showing the information of clothes has be additionally hanged on the clothes in actual use. However, if both a tag and an anti-theft clasp are to be hanged on thin clothes or underclothes, the clothes will lose its shape while causing unpleasant trying-on experience to a client.

SUMMARY

Regarding the problem present in the prior art that clothes lose their shapes due to many accessories hanged thereon, an object of the present application is to provide a clothes tag, which provides both tagging and anti-theft functions, reduces the accessories to be hanged on clothes, and improves the trying-on experience of a client.

For achieving the above object, the present application provides the following technical solution:

a clothes tag, comprising a casing which is provided with an anti-theft clasp and a screen inserted on one side of the casing for showing the information of clothes.

In the above technical solution, providing the anti-theft clasp and the screen on the casing reduces the accessories to be hanged on the clothes and improves trying-on experience of a client. In addition, the information shown on the screen can be changed as needed, so that the tag according to the present application can be repeatedly used.

Further, a screen hole is provided one side of the casing, in which the screen is provided, and an inner chamfer is provided along the edges of the screen hole.

In the above technical solution, providing the screen in the screen hole can effectively prevent the screen from being scraped when the tag according to, the present application is horizontally placed.

Further, the casing assumes a long-strip shape, integrally provided with a protrusion on one side in which the anti-theft clasp is provided.

In the above technical solution, providing the anti-theft clasp in the protrusion facilitates reducing the thickness of the casing.

Further, the protrusion and, the screen are provided on the same side of the casing.

In the above technical solution, when the tag according to the present application is placed on a horizontal surface, the protrusion can obliquely support the casing, facilitating picking up the tag, and additionally preventing the screen from being scraped for being too close to the horizontal surface.

Further, a cell cover is detachably connected on the side of the casing opposite, to the screen, and are chamfers are provided on both edges of the side of the casing opposite to the screen.

In the above technical solution, providing the arc chamfers can remove the burrs on the casing, improving the roundness of the shape of the casing and increasing trying-on comfort of a client.

Further, a boss is integrally fixed on the side of the casing opposite to the protrusion, located on the end where the cell cover is located, and an acoustic magnetic strip for alarming is provided in the boss.

In the above technical solution, providing the boss facilitates picking up the tag according to the present application when being placed horizontally.

Further, an outer chamfer is provided at the edges of the boss.

By the above technical solution, the roundness of the shape of the boss is improved, and the trying-on comfort of a client is increased.

Further, a slope is provided at the end of the casing away from the boss for facilitating picking up the casing, with the cell cover being provided between the boss and the slope.

In the above technical solution, by providing the cell cover between the the boss and the slope, the tag according to the present application is prevented from being scraped and further getting connection loosened.

The tag according to the present application has the following beneficial effects in comparison with the prior art:

(1) providing the anti-theft clasp and the screen on the casing reduces the accessories to be handed on the clothes and improves trying-on experience of a client; and the ability of changing the information shown on the screen as needed achieves the repeated use of tag according to the present application;

(2) further, providing the anti-theft clasp in the protrusion can not only reduce the thickness and volume of the casing, also provide a fulcrum for facilitating picking up the tag according to the present application; and (3) further, providing the inner chamfer, the arc chamfer and the outer chamfer increases the roundness of shape of the tag according to the present application, and improves the comfort of a client when trying on the clothes hanged with the tag according to the present application.

Reference signs: 1. casing; 2. anti-theft clasp; 3. screen; 4. screen hole; 5. inner chamfer; 6. protrusion; 7. cell cover; 8. arc chamfer; 9. boss; 10. outer chamfer; 11. slope; 12. cell; 13. acoustic magnetic strip; and 14. anti-theft nail.

DETAILED DESCRIPTION

For the purpose of better understanding the objects, technical solutions, and beneficial effects of the present application, detailed description will be further provided below in details in connection with embodiments and drawings, which, however, are not intended to limit the implementation of present application thereto.

Figure 1:
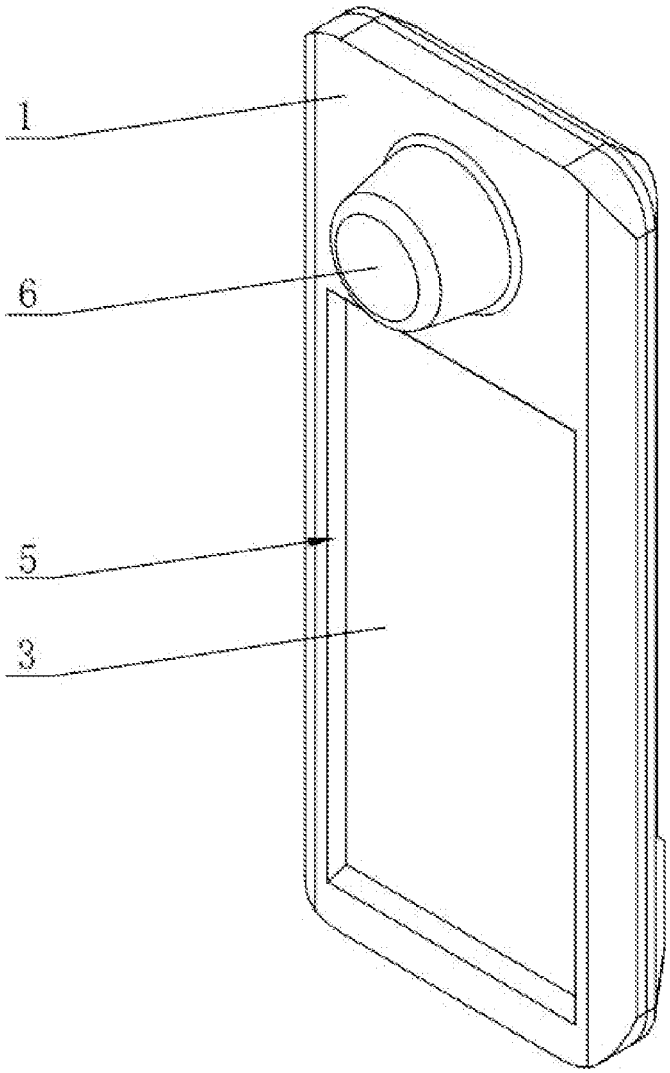
FIG. 1 is a first diagram showing the whole structure of one embodiment of the present application.
Figure 2:
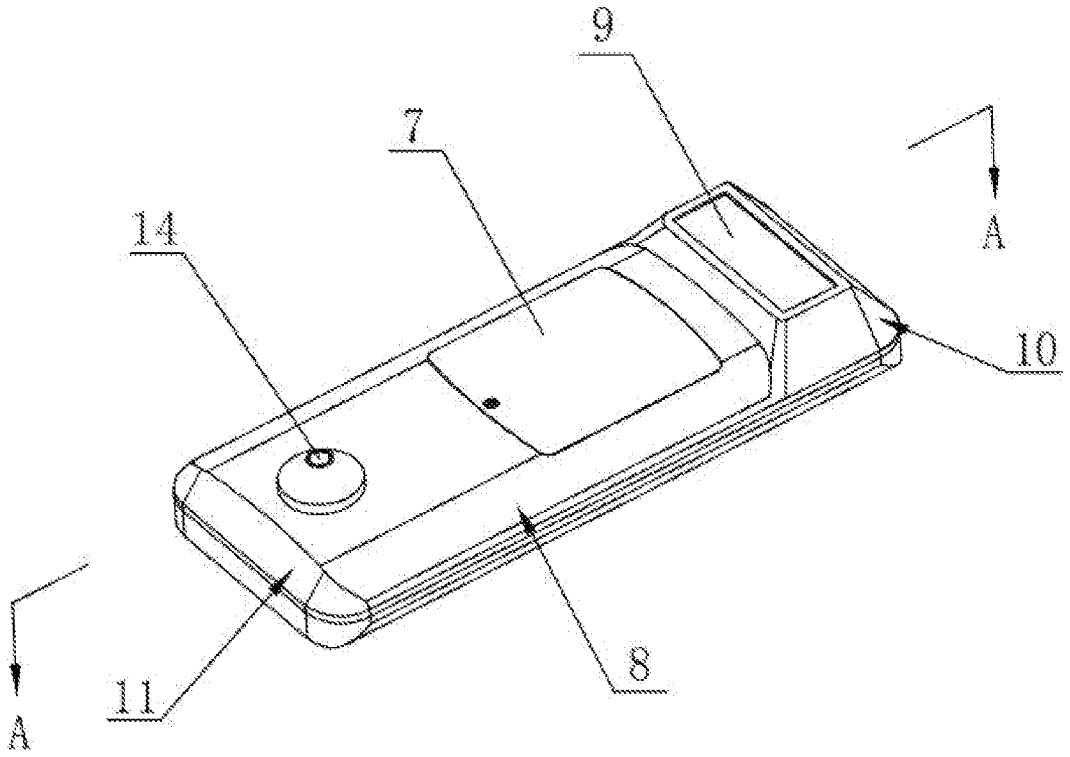
FIG. 2 is a second diagram showing the whole structure of one embodiment of the present application.

A clothes tag is shown in FIG. 1 and FIG. 2. It comprises a plastic casing 1 assuming a long-strip shape. A protrusion 6 is integrally fixed on one side of the casing 1, in which an anti-theft clasp 2 is installed. For example, the anti-theft clasp 2 may be one having a conventional structure. An anti-theft nail 14 is inserted in and matched with the anti-theft clasp 2. A screen 3 for showing the information of clothes, for example, an e-ink screen, is inserted in one side of the casing 1. Providing the anti-theft clasp 2 and the screen 3 on the casing 1 reduces the accessories to be hanged on the clothes and improves the trying-on experience of a client. In addition, the information shown on the screen 3 can be modified as needed, and thus the dress tag according to the present application can be repeatedly used.

Figure 3:
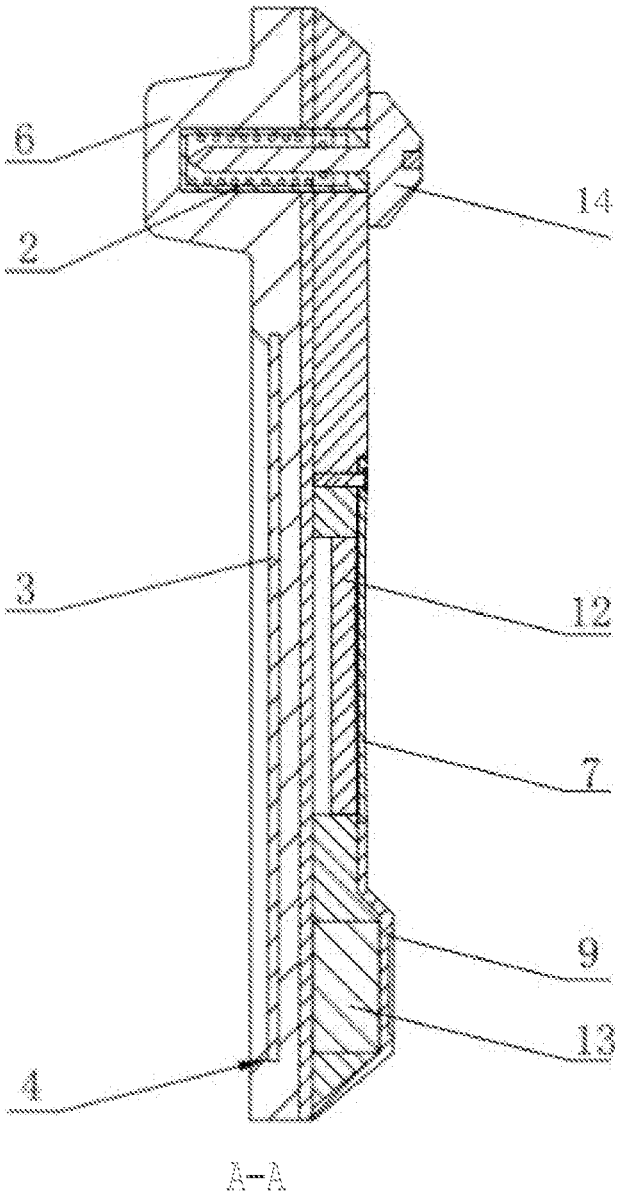
FIG. 3 is a sectional view taken long line A-A in FIG. 2.

As shown in FIG. 2 and FIG. 3, a screen hole 4 is disposed on one side of the casing 1. The screen 3 is inserted in the screen hole 4, and coincides with the screen hole 4 in shape. An inner chamfer 5 is provided along the edges of the screen hole 4 of the casing 1. Providing the screen 3 in the screen hole 4 can prevent it from being easily scraped.

The anti-theft clasp 2 has a relatively large thickness. Providing the anti-theft clasp 2 within a protrusion 6 can reduce the thickness of the casing 1. The protrusion 6 is on the same side of the casing 1 as the screen 3 does. When being placed on a horizontal surface, the protrusion 6 can be supported on the surface, so as to facilitate picking up and prevent the screen 3 from being scraped for being too close to the surface.

A cell cover 7 is detachably connected on the side of the casing 1 opposite to the screen 3. The cell cover 7 is bolt fixed on the casing 1. A cell 12 is removably provided in the casing 1 where the cell cover 7 is located. An arc chamfer 8 is provided along the edges of the side of the casing 1 opposite to the screen 3, which improves the roundness of the casing 1 and in turn the trying-on comfort of a client. A boss 9 is integrally fixed on one side of the casing 1, close to the cell cover 7. An acoustic magnetic strip 13 is installed in the boss 9 of the casing 1. An outer chamfer 10 is provided at the edges of the boss 9. When the back of the casing 1 is placed on a horizontal surface, the boss 9 can obliquely support the casing 1, facilitating picking up the tag according to the present application. Providing the chamfer 10 improves the roundness of the shape of the boss 9. A slope 11 facilitating picking up the casing 1 is provided at the end of the casing 1 away from the boss 9, with the cell cover 7 being positioned between the boss 9 and the slope 11.

In use of the tag according to the present application, providing the anti-theft clasp 2 and the screen 3 on the casing 1 reduces the accessories to be hanged on clothes and improves the trying-on experience of a client. In addition, the information shown on the screen 3 can be changed as needed, facilitating repeated use of the tag according to the present application. Providing the anti-theft clasp 2 within the protrusion 6 can not only reduce the thickness and volume of the casing 1, also provide a supporting point for the convenience of picking up the tag. Providing the inner chamfer 5, the art chamfer 8 and the outer chamfer 10 can improve the roundness of the shape, of the tag according to the present application, and in turn the comfort of a client when trying on the clothes hanged with the tag according to the present application. What are provided above are only some of the preferred embodiments of the present application, without limiting the scope of the present application thereto; and, on the contrary, all the technical solutions made based on the concept of the present application are within the scope of the present application. Those skilled in the art will understand that, several alternations and modifications made without departing from the principle of the present application should be considered as falling in the scope of the present application.

The invention claimed is:

1. A clothes tag, comprising a casing (1), characterized in that an anti-theft clasp (2) is provided on the casing (1), and a screen (3) is inserted in one of the casing (1) for showing the information of the clothes;

wherein the casing (1) assumes a long-strip shape, and is integrally provided with a protrusion (6) on one side in which the anti-theft clasp (2) is disposed;

the protrusion (6) and the screen (3) are provided on the same side of the casing (1); and a cell cover (7) is detachably connected on the side of the casing (1) opposite to the screen (3), and an arc chamfer (8) is provided on both edges of the side of the casing (1) opposite to the screen (3).

2. The clothes tag according to claim 1, characterized in that, a screen hole (4) is disposed on one side of the casing (1) for exposing the screen (3), and an inner chamfer (5) is provided along the edges of the screen hole (4) of the casing (1).

3. The clothes tag according to claim 1, characterized in that, a boss (9) is integrally fixed on the side of the casing (1) opposite to the protrusion (6), located on the end where the cell cover (7) is located, and an acoustic magnetic strip (13) for alarming is provided in the boss (9).

4. The clothes tag according to claim 3, characterized in that, an outer chamfer (10) is provided at the edges of the boss (9).

5. The clothes tag according to claim 4, characterized in that, a slope (11) is provided at the end of the casing (1) away from the boss (9) for facilitating picking up the casing (1), with the cell cover (7) being provided between the boss (9) and the slope (11).

* * * * *